US009699567B2

(12) United States Patent
Huang et al.

(10) Patent No.: US 9,699,567 B2
(45) Date of Patent: Jul. 4, 2017

(54) WEARABLE COMMUNICATION DEVICE

(71) Applicant: ASUSTeK COMPUTER INC., Taipei (TW)

(72) Inventors: Lai-Shi Huang, Taipei (TW); Yi-Chuan Chen, Taipei (TW); Hsin-Yu Lu, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 0 days.

(21) Appl. No.: 14/568,133

(22) Filed: Dec. 12, 2014

(65) Prior Publication Data

US 2015/0172824 A1 Jun. 18, 2015

(30) Foreign Application Priority Data

Dec. 16, 2013 (TW) ..... 102146117 A

(51) Int. Cl.
*H04R 25/00* (2006.01)
*H04R 17/00* (2006.01)
*H04R 3/12* (2006.01)

(52) U.S. Cl.
CPC ..... *H04R 17/00* (2013.01); *H04R 3/12* (2013.01); *H04R 2217/00* (2013.01); *H04R 2217/01* (2013.01); *H04R 2217/03* (2013.01)

(58) Field of Classification Search
CPC ..... H04R 2217/00; H04R 2217/01; H04R 2217/03; H04R 17/00; H04R 3/12
USPC ..... 381/190
See application file for complete search history.

(56) References Cited

U.S. PATENT DOCUMENTS 5,539,831 A * 7/1996 Harley ..... A61B 7/04 381/151
6,912,287 B1 6/2005 Fukumoto et al.
2002/0121981 A1* 9/2002 Munch ..... G08B 21/06 340/576
2007/0030984 A1* 2/2007 Gotfried ..... H04N 7/147 381/122
2011/0213274 A1* 9/2011 Telfort ..... A61B 7/003 600/586
2012/0218184 A1* 8/2012 Wissmar ..... G06F 3/0346 345/158
2013/0120106 A1* 5/2013 Cauwels ..... G06F 1/163 340/3.1

FOREIGN PATENT DOCUMENTS

CN 201252537 Y 6/2009
CN 102104687 A 6/2011
(Continued)

*Primary Examiner* — Duc Nguyen
*Assistant Examiner* — Sean H Nguyen
(74) *Attorney, Agent, or Firm* — CKC & Partners Co., Ltd.

(57) ABSTRACT

A wearable communication device includes an annular shell, a processing module, a first piezoelectric unit, and a driving unit. A cavity is formed at a part of the annular shell. The processing module processes communication data. The first piezoelectric unit is disposed in the cavity. The driving unit is used to receive the communication data and drive the first piezoelectric unit according to the communication data to make the first piezoelectric unit vibrate and trigger a corresponding audio signal. The wearable communication device can be wirelessly connected to an electronic device without physical wires to improve the convenience greatly.

9 Claims, 7 Drawing Sheets

(56) References Cited

FOREIGN PATENT DOCUMENTS

| | | | |
|---|---|---|---|
| CN | 201903695 | U | 7/2011 |
| CN | 102348020 | A | 2/2012 |
| JP | 2004128915 | A | 4/2004 |

* cited by examiner

WEARABLE COMMUNICATION DEVICE

CROSS-REFERENCE TO RELATED APPLICATION

This application claims the priority benefit of TW application serial No. 102146417, filed on Dec. 16, 2013. The entirety of the above-mentioned patent application is hereby incorporated by reference herein and made a part of specification.

BACKGROUND OF THE INVENTION

Field of the Invention

The disclosure relates to a communication device and, more particularly, to a wearable communication device.

Description of the Related Art

With the development of wireless communication technology, wireless communication devices become popular, especially wearable communication devices, such as a bluetooth headset, via the connection between a communication device and an electronic device, the user does not need to handheld an electronic device while communication.

BRIEF SUMMARY OF THE INVENTION

The wearable communication device disclosed herein includes an annular shell, a processing module, a first piezoelectric unit, and a driving unit. A cavity is formed at a part of the annular shell. The processing module processes communication data. The first piezoelectric unit is disposed in the cavity. The driving unit is used to receive the communication data and drive the first piezoelectric unit according to the communication data to make the first piezoelectric unit vibrate and trigger a corresponding audio signal.

The wearable communication device provides multiple ways for selecting to receive sound and output the audio signal. The wearable communication device can receive sound via a microphone or a piezoelectric unit, and the audio signal is outputted via the piezoelectric unit and the wave guide.

As a result, when the wearable communication device worn at a finger, a neck, or an earring is close to the ear, the audio signal can be transmitted from the wearable communication device to the ear via air, and thus the interference of the environment can be avoided.

In addition, when the wearable communication device is wirelessly connected to the electronic device, without physical lines, it improves the convenience greatly. Moreover, the wearable communication device can be manufactured into small size for easily carried by wearing it at a finger, a neck, an ear, which decreases the probability of being lost.

DETAILED DESCRIPTION OF THE EMBODIMENTS

These and other features, aspects, and advantages of the disclosure will become better understood with regard to the following description, appended claims, and accompanying drawings. However, the embodiments are not limited herein. The description of the operation of components is not used for limiting the execution sequence. Any equivalent device with the combination according to the disclosure is in the scope of the disclosure. The components shown in figures are not used for limit the size or the proportion.

"The first", "the second" and so on are not used to limit the order, they are also not used to limit the disclosure, and they are only used to distinguish components or operations with same technical terms.

The term "connected" represents that two or more components are contacted physically or electronically, and the contact therebetween may be direct or indirect, and it also represents that two or more components communicate, operate or act with each other, which is not limited herein.

Figure 1A:
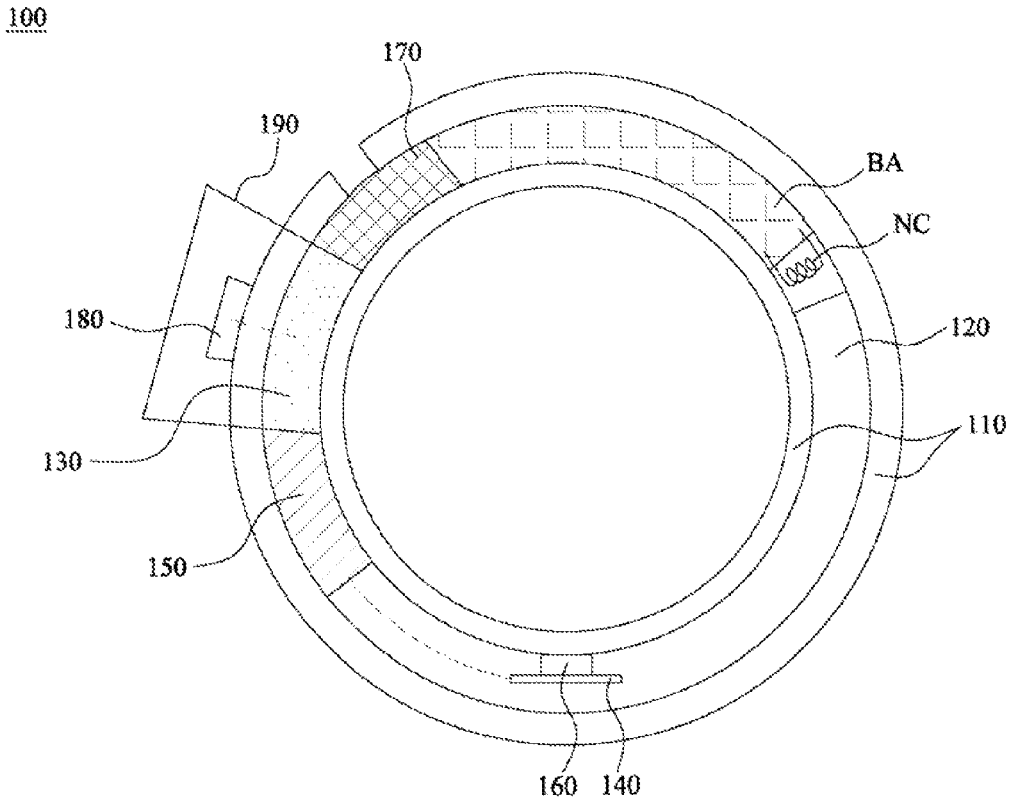
FIG. 1A is a schematic diagram showing a wearable communication device in a first embodiment.
Figure 2:
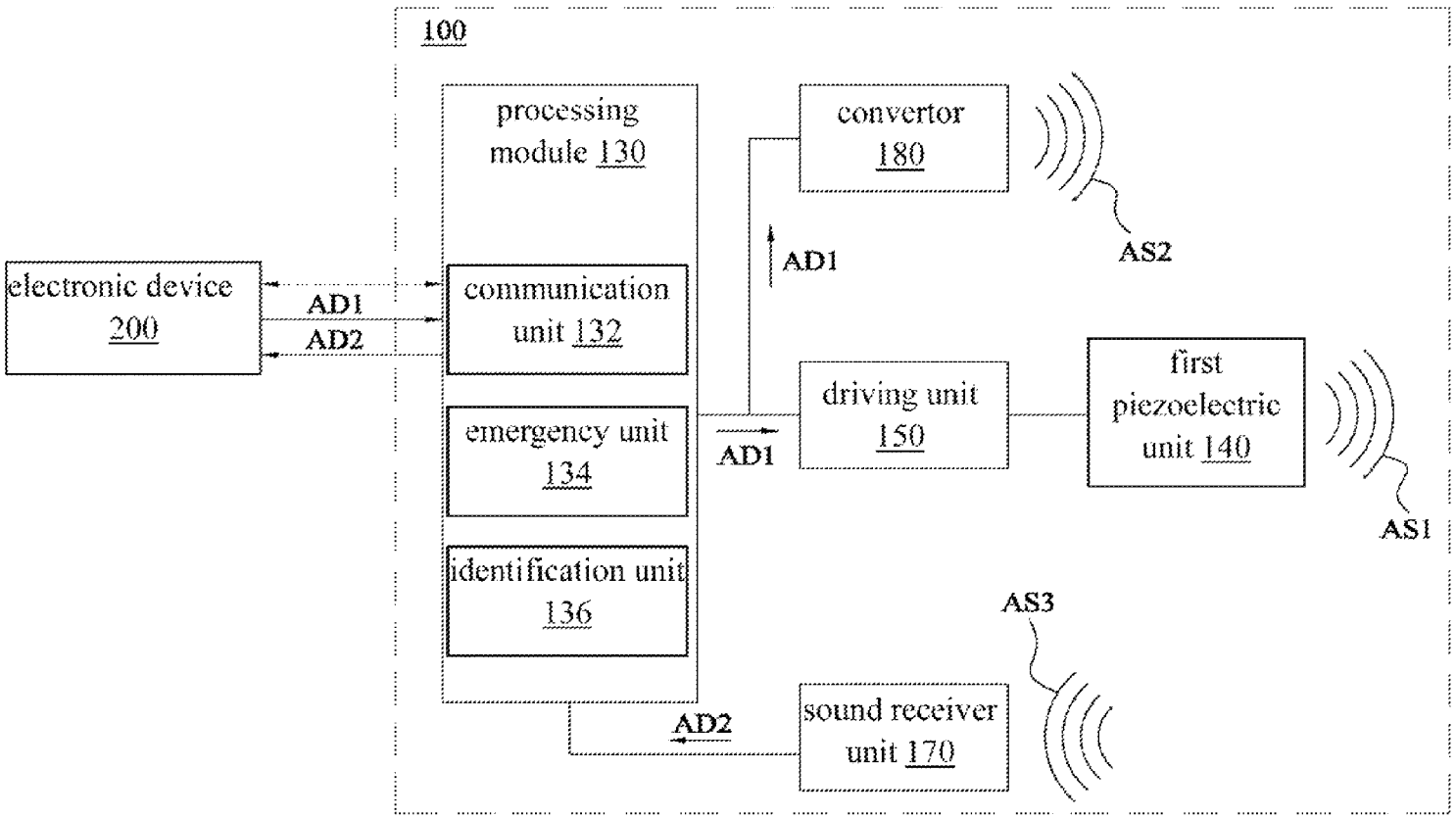
FIG. 2 is a block diagram showing a wearable communication device in the first embodiment.

FIG. 1A is a schematic diagram showing a wearable communication device in a first embodiment. FIG. 2 is a block diagram showing a wearable communication device in the first embodiment. As shown in FIG. 1A, the wearable communication device 100 includes an annular shell 110, a processing module 130, a first piezoelectric unit 140 and a driving unit 150.

In an embodiment, the driving unit 150 can be integrated to the processing module 130, which is not limited herein. In an embodiment, the annular wearable communication device 100 is a ring, a bracelet, a necklace or any accessories that can be worn.

In an embodiment, a cavity 120 is formed at a part of the annular shell 110. As the section view shown in FIG. 1A, the annular shell 110 includes an inner loop and an outer loop, the cavity 120 is between the inner loop and the outer loop, which is not limited herein. In an embodiment, the inner loop and the outer loop of the annular shell 110 are schematically outlined to show a side that close to the center of the circle and a side that far away from the center of the circle, respectively, which are not means physically two ring components.

In the embodiment, the annular shell 110 is a ring. In other embodiments, the annular shell 110 is square outside and round inside or polygon outside (such as octagon), or the annular shell 110 is ring shaped with an opening (as shown in FIG. 1A), which is not limited herein.

The processing module 130 is disposed in the cavity 120. The processing module 130 includes a communication unit 132 that wirelessly connected to the electronic device 200. In an embodiment, the communication unit 132 at least includes one of a Bluetooth circuit, a WiFi circuit, a WiFi-Direct circuit, a Zigbee circuit or other NFC circuits, which is not limited herein. In an embodiment, the communication unit 132 is used to recognize the electronic device 200. After the recognition, the communication unit 132 builds a wireless connection between the wearable communication device 100 and the electronic device 200, then, the processing module 130 receives the communication data AD1 from the electronic device 200 or transmits the audio data AD2 to the electronic device 200.

In an embodiment, the electronic device 200 may be a mobile electronic device, an appliance, a vehicle device, which is not limited herein.

The first piezoelectric unit 140 is disposed in the cavity 120, when a voltage is received, the first piezoelectric unit 140 vibrates to generate an audio signal AS1 according to the voltage.

The driving unit 150 is disposed in the cavity 120, it is electrically connected to the processing module 130 and the first piezoelectric unit 140 to receive a communication data AD1 outputted from the processing module 130 and output a voltage to drive the first piezoelectric unit 140 according to the communication data AD1, so as to make the first piezoelectric unit 140 vibrate and generate a corresponding audio signal AS1 according to the voltage.

In an embodiment, as shown in FIG. 1A, the wearable communication device 100 further includes a fixing member 160. The fixing member 160 is disposed in the cavity 120 to connect to the first piezoelectric unit 140 and the annular shell 110, so as to make the first piezoelectric unit 140 drive the annular shell 110 via the fixing member 160 when the first piezoelectric unit 140 vibrates, and then the wearable communication device 100 vibrates.

In FIG. 1A, the fixing member 160 is disposed in the cavity 120 and closely against the inner loop of the annular shell 110, the connection position between the fixing member 160 and the annular shell 110 can be changed according to practical requirements. For example, the fixing member 160 can be disposed in the cavity 120 and closely against the outer loop of the annular shell 110, which is not limited herein.

The interaction between the wearable communication device 100 and the electronic device 200 is illustrated hereinafter in an embodiment. When the electronic device 200 receives a notification from a base station, the electronic device 200 transmits specific communication data AD1 to the communication unit 132 wirelessly. The communication data AD1 may be audio data such as a vibration or a ring tone, and it may be other data such as electronic data, which is not limited herein.

Then, the communication unit 132 outputs the communication data AD1 to the driving unit 150. The driving unit 150 generates a voltage according to the communication data AD1 to drive the first piezoelectric unit 140, so as to make the first piezoelectric unit 140 vibrate and generate a corresponding audio signal AS1 (such as a vibration or a specific ring tone). Via the bone conduction, the user notices an incoming call according to the vibration or the ring tone of the wearable communication device 100.

In an embodiment, if the communication data AD1 is not the audio data, the driving unit 150 also generates a voltage according to the communication data AD1 to drive the first piezoelectric unit 140, and then the first piezoelectric unit 140 vibrates and generates a corresponding audio signal AS1, the communication data AD1 also can be carried at the audio signal AS1 via a carrier wave, which is not limited herein.

The wearable communication device 100 can be worn at the finger just like a ring. An incoming call can be known via a vibration or a ring tone of the wearable communication device 100, and the missed calls can be reduced in contrast with that when the communication device is at a bag or a packet.

Then, at the wearable communication device 100 is enable via a gesture, a press on an answer unit or via a voice control to transmit an answer command or a volume control command to the wearable communication device 100, and the instruction is transmitted to the electronic device 200 via the wireless connection of the wearable communication device 100. In an embodiment, the answer unit may be a physical button, a touch module, a virtual key, a rotary type key, which is not limited herein.

After the answer command or the volume control command is received, the electronic device 200 wirelessly transfers the communication data AD1 (the content is corresponding to the call content from the caller) to the communication unit 132. Then, the communication unit 132 transfers the communication data AD1 to the driving unit 150. The driving unit 150 generates corresponding voltages in sequence to drive the first piezoelectric unit 140 according to the communication data AD1, so as to make the first piezoelectric unit 140 vibrate and generate corresponding audio signals AS1.

However, the audio signal AS1 of the first piezoelectric unit 140 is received when the wearable communication device 100 is placed close to an ear. To hear clearly in a noisy environment, the annular shell 110 of the wearable communication device 100 can be directly contact the ear.

In an embodiment, the wearable communication device 100 further includes a sound receiver unit 170. The sound receiver unit 170 is disposed in the cavity 12 and electrically connected to the processing module 130. The sound receiver unit 170 is used to receive the sound AS3 and convert the sound AS3 to the audio data AD2, and output the audio data AD2 to the processing module 130, the communication unit 132 of the processing module 130 transfers the audio data AD2 to the electronic device 200.

The sound receiver unit 170 further includes a microphone, such as a waterproof microphone. As shown in FIG. 1A, an opening is formed at the outer loop of the annular shell 110 adjacent to the microphone of the sound receiver unit 170 to make the sound AS3 transmit through the opening to the microphone freely, and then the microphone can capture the sound AS3 from all directions.

In an embodiment, when the electronic device 200 receives a notification from the base station and makes the wearable communication device 100 vibrate or generate a ring tone, the answer command can be generated via the sound receiver unit 170 of the wearable communication device 100 in a voice control way and transferred back to the electronic device 200.

Then, after the answer command is received, the electronic device 200 transfers the communication data AD1 to the communication unit 132 wirelessly (the content is corresponding to the phone conversation from the caller). Meanwhile, the voice of the user is converted to the audio data AD2, and transferred back to the electronic device 200 via the sound receiver unit 170 of the wearable communication device 100.

However, the audio data AD2 transferred back to the electronic device 200 includes examples of, but is not limited to, the answer command and the phone conversations. In an embodiment, the audio data AD2 received by the sound receiver unit 170 is a voice control instruction to enable a specific program (such as a mail), to search information (such as weather, date, real-time financial information such as exchange rate) or to verify users' identification (such as voiceprint), which is not limited herein.

The communication data AD1 transmitted to the wearable communication device 100 of the electronic device 200 includes examples of, but is not limited to, the call notification and the phone conversation. Practically, the communication data AD1 received by the wearable communication device 100 may be an audio file generated by a specific program (such as a voice mail service), a voice report of specific information (such as weather, date and real-time financial information such as exchange rate), or a sound effect or an alarm signal generated from the electronic device 200, which is not limited herein.

Figure 1B:
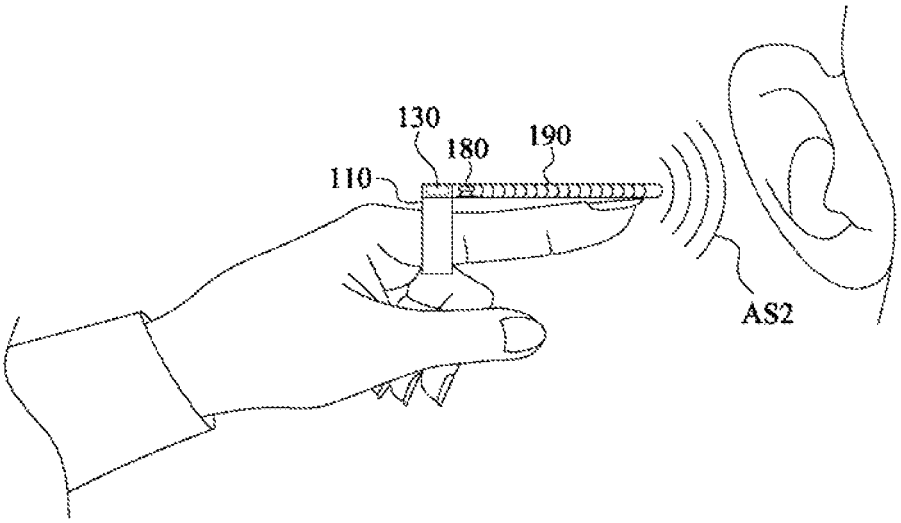
FIG. 1B is a schematic diagram showing a wearable communication device in a second embodiment.

FIG. 1B is a schematic diagram showing a wearable communication device in a second embodiment. The wearable communication device 100 further includes a convertor 180 and a wave guide 190. The convertor 180 is electrically connected to the processing module 130 to convert the communication data AD1 from the processing module 130 and output a sound wave AS2. The wave guide 190 is used to transmit the sound wave AS2 output from the convertor 180 (the convertor 180 is disposed in the wave guide 190) to reduce the interference of the sound wave AS2 by the external environment while transmission, which is not limited herein.

In an embodiment, as shown in FIG. 1A and FIG. 1B, the wave guide 190 is disposed in the outer loop of the annular shell 110, and the wave guide 190 is perpendicular to the surface formed by the annular shell 110, and thus when the wearable communication device 100 is worn at the finger, the wave guide 190 is parallel to the finger, which is not limited herein. The wave guide 190 can be designed according to the appearance of the wearable communication device, and the wave guide 190 can be configured at wearable communication device 100 in various configurations. Under the condition of the same conduction effect, the appearance of the wearable communication device can be various.

In an embodiment, when the wearable communication device 100 communicates wirelessly to the electronic device 200, the wearable communication device 100 sends the answer command by a gesture, a press on the answer unit (not shown) of the wearable communication device 100 or by the voice control, and the electronic device 200 wirelessly transmits the communication data AD1 to the communication unit 132, which is not limited herein.

Then, the communication unit 132 transmits the communication data AD1 to the convertor 180 to generate a sound wave AS2 according to the communication data AD1. Meanwhile, the user hears voices with the sound wave AS2 when the opening of the wave guide 190 is close to the ear, which is not limited herein.

In an embodiment, as shown in FIG. 2, the processing module 130 further includes an emergency unit 134. The emergency unit 134 wirelessly transmits an emergency signal to the electronic device 200, and the electronic device 200 automatically makes calls or sends messages to any emergency services, which is not limited herein.

For example, when an emergency button (not shown) at the annular shell 110 is pressed, the emergency unit 134 transmits the emergency signal to the electronic device 200 to make the electronic device 200 automatically makes calls or sends messages to any emergency services. In an embodiment, the way to contact emergency services can be set in advance and base on the requirements of users, and the emergency services includes friends, police office, hospital or telecom service provider, which is not limited herein.

In an embodiment, the wearable communication device 100 further includes a locating module (not shown) to provide location information. When the electronic device 200 does not include location information, the emergency unit 134 not only transmits the emergency signal to the electronic device 200, it also transmits the location information to the electronic device 200 for the emergency, which is not limited herein.

The processing module 130 further includes an identification unit 136. The identification unit 136 is used to output the identification signal to make the external device (intelligence appliances such as a television, a lamp, a door lock, and a vehicle computer) to identify the wearable communication device 100, and then the wearable communication device 110 can wirelessly operate the external devices. In an embodiment, the identification of the identification unit 136 may be achieved by near field communication (NFC) or radio frequency identification (RFID) technology, which is not limited herein.

For example, if the identification of the identification unit 136 is achieved by NFC technology, when the wearable communication device 100 is close to an external device (such as a television, a computer, a stereo, or a lamp), the wearable communication device 100 transmits the identification signal to make the external device recognize the wearable communication device 100, and the wearable communication device 100 can operate external devices, which is not limited herein.

If the identification of the identification unit 136 is achieved by RFID technology, only if the distance between the external device and the identification unit 136 of the wearable communication device 100 worn at the finger is in the wireless communication range according to the RFID technology, the external device can identify the wearable communication device 100 via the identification signal from the identification unit 136, and the wearable communication device 100 can operate external devices.

In an embodiment, as shown in FIG. 1A, the wearable communication device 100 further includes a battery BA and an induction coil NC. In an embodiment, the induction coil NC is a receiving coil for wireless charging, it includes a magnetic core and the induction coil winds at the magnetic core. In an embodiment, the induction is performed by a receiving coil. The induction coil NC is used for inducing the magnetic variation and converts the magnetic field to electric energy, so as to charge the battery BA. Additionally, except for the induction coil NC, the device for charging the battery of the communication device 100 may be a photovoltaic panel, which is not limited herein.

When the wearable communication device 100 approaches or is placed on a wireless charging module (such as a wireless charging dock), the coil in the wireless charging module generates a magnetic field, the magnetic field is various over time, the induction coil NC of the wearable communication device 100 induces the change of the magnetic field and converts the magnetic field to the electric energy to charge the battery BA. Consequently, without additional charging slot on the wearable communication device 100, the dimension of the wearable communication device 100 can be reduced, which is not limited herein.

Figure 3A:
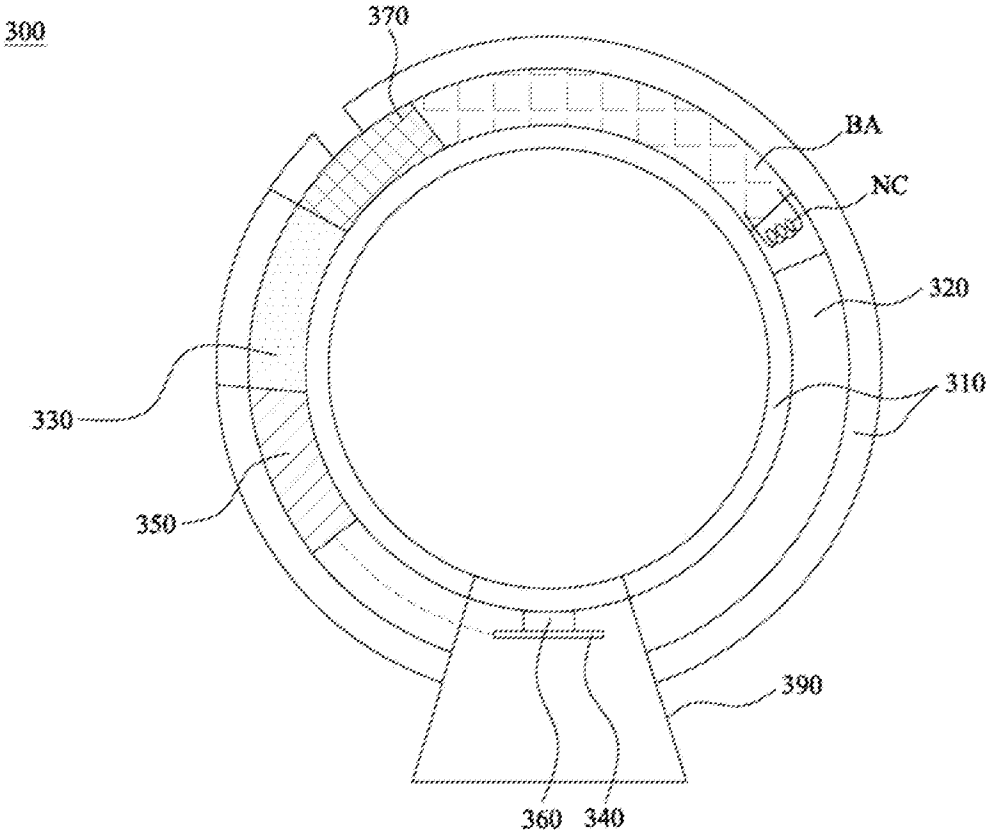
FIG. 3A is a schematic diagram showing a wearable communication device in a third embodiment.
Figure 3B:
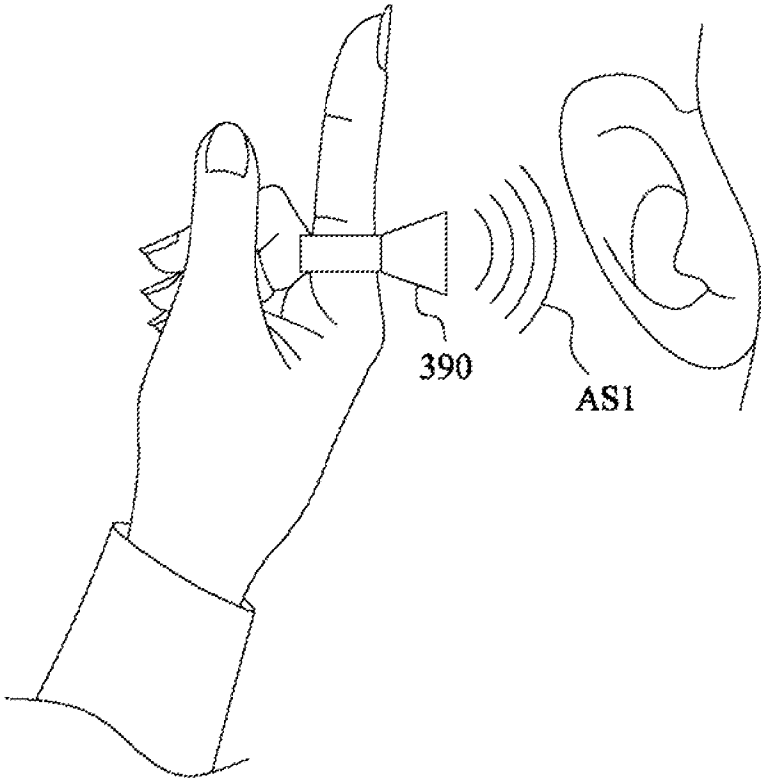
FIG. 3B is a schematic diagram showing a wearable communication device in a fourth embodiment.

FIG. 3A is a schematic diagram showing a wearable communication device in a third embodiment. FIG. 3B is a schematic diagram showing a wearable communication device in a fourth embodiment. The wearable communication device 300 includes an annular shell 310, a cavity 320, a processing module 330, a first piezoelectric unit 340, a driving unit 350, a fixing member 360, a sound receiver unit 370, a battery BA and an induction coil NC.

In this embodiment, the configuration and the connection of the annular shell 310, the cavity 320, the processing module 330, the first piezoelectric unit 340, the driving unit 350, the fixing member 360, the sound receiver unit 370, the battery BA and the induction coil NC are similar to those in FIG. 1A, which are omitted herein.

Figure 4:
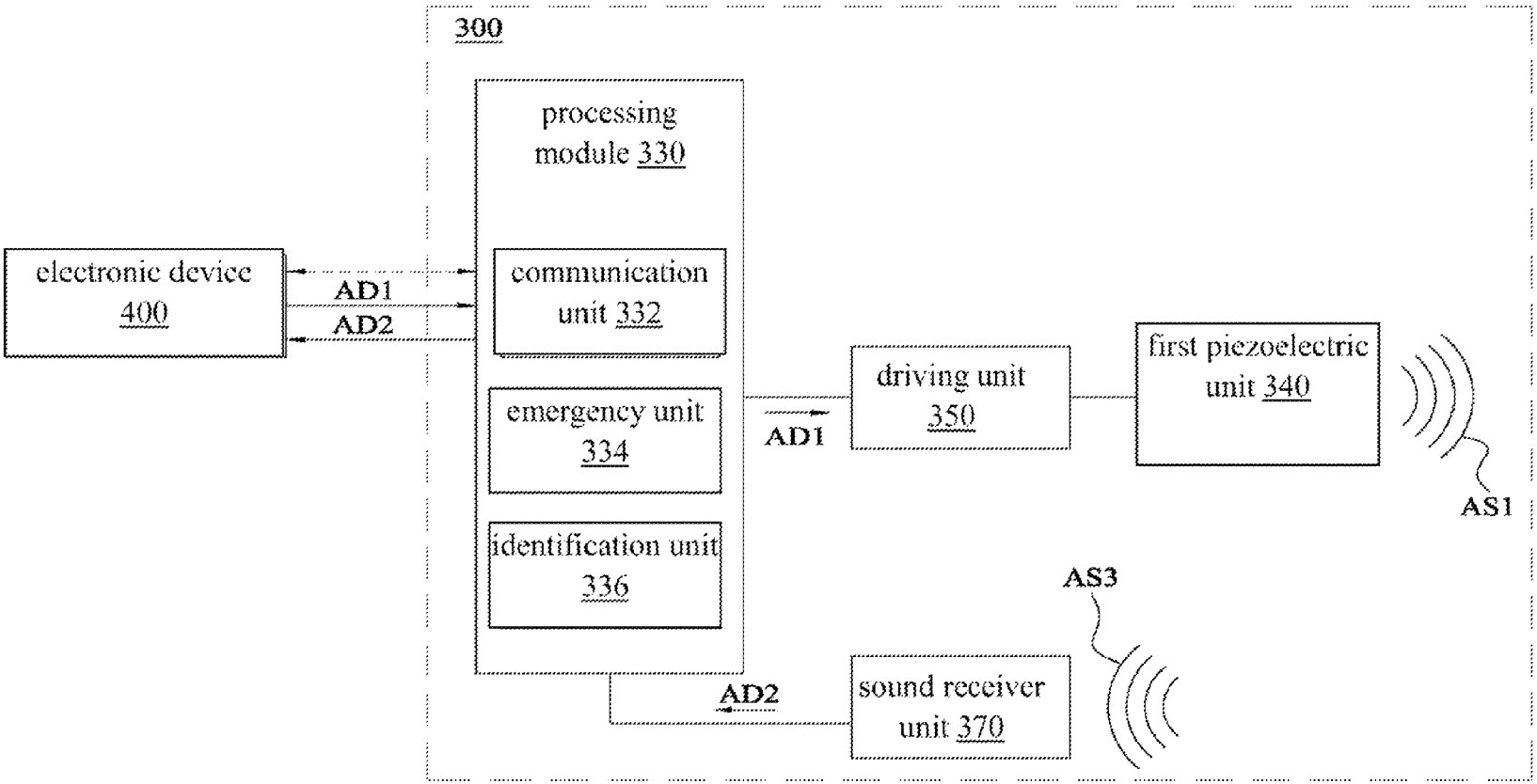
FIG. 4 is a block diagram showing a wearable communication device in a third embodiment.

FIG. 4 is a block diagram showing a wearable communication device in a third embodiment. As shown in FIG. 4, the internal operation of the wearable communication device 300 and that of the electronic device 400 are similar to that in FIG. 2, which is omitted herein.

In an embodiment, the wave guide 190 in FIG. 1A disposes at other positions of the wearable communication device 100, which is not limited to that in the first embodiment. As shown in FIG. 3A, the wave guide 390 includes a first piezoelectric unit 340 therein, and an opening is formed at the outer loop of the annular shell 310 to make the wave guide 390 output the audio signal AS1 from the first piezoelectric unit 340 (as shown in FIG. 3B and FIG. 4) to reduce the external environment interference of the audio signal AS1 while transmission, which is not limited herein.

Additionally, in the first embodiment, the sound wave AS2 transmits after converted and output from the convertor, in this embodiment, the first piezoelectric unit 340 outputs the audio signal AS1, and the audio signal AS1 does not need to be converted by the convertor, the audio signal AS1 can be completely output to users via the wave guide 390 directly.

Figure 5:
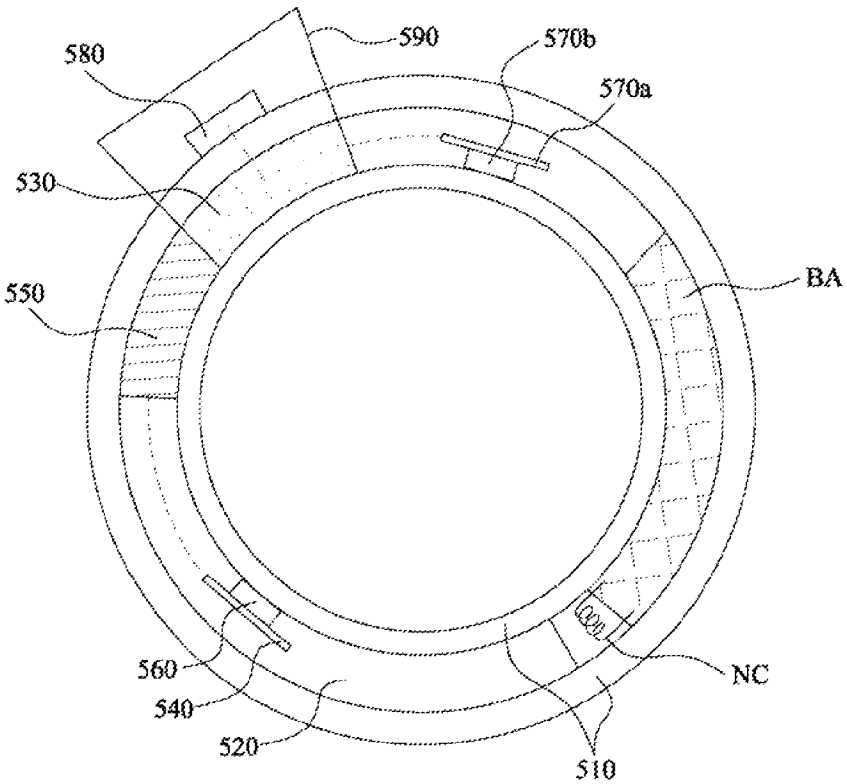
FIG. 5 is a schematic diagram showing a wearable communication device in a fifth embodiment.

FIG. 5 is a schematic diagram showing a wearable communication device in a fifth embodiment. The wearable communication device 500 includes an annular shell 510, a cavity 520, a processing module 530, a first piezoelectric unit 540, a driving unit 550, a fixing member 560, a battery BA and an induction coil NC.

In this embodiment, the configuration and the connection between the annular shell 510, the cavity 520, the processing module 530, the first piezoelectric unit 540, the driving unit 550, the fixing member 560, the battery BA and the induction coil NC are similar to those in FIG. 1A, which is omitted herein.

In this embodiment, the wearable communication device 500 further includes a second piezoelectric unit 570*a* and a fixing member 570*b*. The second piezoelectric unit 570*a* is disposed in cavity 520, it is connected to the inner loop of the annular shell 510 via the fixing member 570*b*, and the second piezoelectric unit 570*a* is electrically connected to the processing module 530.

The second piezoelectric unit 570*a* is used to receive the vibration of the sound AS3 and generates a corresponding voltage to form the audio data AD2, and the audio data AD2 is wirelessly transmitted to the electronic device via the processing module 530.

In an embodiment, the second piezoelectric unit 570*a* detects a physiological signal except for a sound. For example, the pulse of a finger can be transmitted to the second piezoelectric unit 570*a* via the fixing member 570*b* to make the second piezoelectric unit 570*a* generate a corresponding voltage according to the pulse of a user. Then, the processing module 530 receives the voltage and transmits to the electronic device, which is not limited herein.

The connection way between the fixing members 160, 360, 560, 570*b* piezoelectric units 140, 340, 540, 570*a*, respectively, are not limited herein. As shown in FIG. 1A, FIG. 3A or FIG. 5, one end of the fixing member 160, 360, 560, 570*b* is connected to the inner loop, the other end is connected to the piezoelectric unit. On the other hand, the fixing member 160, 360, 560, 570*b* disposes in a film-shape, two ends of the piezoelectric unit are connected to the outer loop via the fixing member 160, 360, 560, 570*b*, respectively, to form an enclosed space. The enclosed space can be regarded as an acoustic space, to improve the sound quality, which is not limited herein.

In sum, when the wearable communication device is wirelessly connected to the electronic device, without physical lines, it improves the convenience greatly. Additionally, the wearable communication device provides multiple ways to receive sound and output the audio signal. Moreover, by integrating the identification unit, the external device can identify the wearable communication device, the second piezoelectric unit also can be integrated to detect a physiological signal, which can enrich the function of the wearable communication device.

Although the disclosure has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A wearable communication device, communicates with an electronic device, and the electronic device provides communication data, the wearable communication device comprising:

an annular shell including an inner loop, an outer loop and a cavity between the inner loop and the outer loop;

a processing module for processing the communication data;

a first piezoelectric unit disposed in the cavity;

a second piezoelectric unit disposed in the cavity;

a driving unit receiving the communication data to trigger the first piezoelectric unit vibrate and generate a corresponding audio signal; and a fixing member disposed in the cavity and connected the first piezoelectric unit and the annular shell, wherein the fixing member disposes in a film-shape, two ends of the piezoelectric unit are connected to the outer loop via the fixing member, respectively, to form an enclosed space;

wherein when the second piezoelectric unit receives a sound, the second piezoelectric unit detects a vibration of the sound to generate a corresponding first voltage to form an audio data, and when the second piezoelectric unit is not receiving the sound, the second piezoelectric unit detects a physiological signal of a user, and generates a corresponding second voltage and transmits the second voltage to the processing module.

2. The wearable communication device according to claim 1, wherein the sound receiver unit further includes;

a microphone;

wherein an opening is formed at the annular shell and adjacent to the microphone.

3. The wearable communication device according to claim 1, further comprising:

a convertor used for convening the communication data from the processing module to a sound wave; and a wave guide disposed in the annular shell and used to transmit the sound wave.

4. The wearable communication device according, to claim 1, wherein the processing module further comprising:

an emergency unit used for transmitting an emergency signal to the electronic device.

5. The wearable communication device according to claim 1, wherein the processing module further comprising:

an identification unit used for outputting an identification signal for an external device to recognize the wearable communication device.

6. The wearable communication device according to claim 5, wherein identification of the identification unit is achieved by near field communication (NFC) technology or radio frequency identification (RFID) technology.

7. The wearable communication device according to claim 1, further comprising:

a battery; and an induction coil used to charge the battery.

8. The wearable communication device according to claim 1, wherein the driving unit is integrated to the processing module.

9. The wearable communication device according to claim 1, further comprising:

a sound receiver unit disposed in the cavity to receive the sound and generate the audio data to the processing module, and the processing module outputs the audio data.

* * * * *